US006518878B1

(12) United States Patent
Skoff

(10) Patent No.: US 6,518,878 B1
(45) Date of Patent: Feb. 11, 2003

(54) WARNING SYSTEM

(76) Inventor: Roger E. Skoff, 9480 Utica St., Suite 612, Rancho Cucamonga, CA (US) 91730

( * ) Notice: Subject to any disclaimer, the term of this patent is extended or adjusted under 35 U.S.C. 154(b) by 0 days.

(21) Appl. No.: 09/538,323

(22) Filed: Mar. 30, 2000

(51) Int. Cl.[7] ..... G08B 29/00

(52) U.S. Cl. ..... 340/506; 340/511; 340/517; 340/521; 340/533

(58) Field of Search ..... 340/506, 507, 340/511, 517, 521, 526, 533, 3.1

(56) References Cited

U.S. PATENT DOCUMENTS 5,086,385 A * 2/1992 Launey et al. ..... 340/825.37 X
5,400,246 A * 3/1995 Wilson et al. ..... 340/825.06 X

* cited by examiner

*Primary Examiner*—Daryl Pope
(74) *Attorney, Agent, or Firm*—Timothy Thut Tyson; Ted Masters; Freilich, Hornbaker & Rosen

(57) ABSTRACT

A warning system (20) includes a central control unit (CCU), and a plurality of local units (LU) connected to the central control unit (CCU). Each local unit (LU) includes a plurality of input trips ($A_n$), such as smoke detector, an earthquake detector, and gas detector, and a plurality of programmable responses, such as a bypass relay (C), a message delivered by a record/playback unit (D), an emergency light (E), and a strobe light (F). The input trips ($A_n$) also include a disconnect trip ($A_1$), which is activated by a detector input signal (DI) sent from the central control unit (CCU), and indicates that the central control unit (CCU) has malfunctioned. The programmable responses include a warning output signal (WO) which is sent from the local unit (LU) to the central control unit (CCU) to indicate the presence of a local emergency at the local unit (LU).

13 Claims, 2 Drawing Sheets

| CONDITION | RESPONSE: Emergency Light | Strobe Light | Normal Audio (MI) disconnected | Audio Message broadcast | Signal to CCU (WO) |
|---|---|---|---|---|---|
| SMOKE detected | YES | YES | YES | YES | YES |
| EARTHQUAKE detected | YES | YES | YES | YES | YES |
| PROXIMITY/ MOTION detected | NO | NO | NO | NO | YES |
| NOXIOUS/POISON GAS detected | YES | YES | YES | YES | YES |
| LOSS OF LOCAL POWER detected | NO | NO | NO | NO | YES |
| LOSS OF CCU detected (DI) | YES | YES | YES | YES | NO |

Fig. 2

| CONDITION | RESPONSE: Emergency Light | Strobe Light | Normal Audio (MI) disconnected | Audio Message broadcast | Signal to CCU (WO) |
|---|---|---|---|---|---|
| SMOKE detected | YES | YES | YES | YES | YES |
| EARTHQUAKE detected | YES | YES | YES | YES | YES |
| PROXIMITY/ MOTION detected | NO | NO | NO | NO | YES |
| NOXIOUS/POISON GAS detected | YES | YES | YES | YES | YES |
| LOSS OF LOCAL POWER detected | NO | NO | NO | NO | YES |
| LOSS OF CCU detected (DI) | YES | YES | YES | YES | NO |

WARNING SYSTEM

TECHNICAL FIELD

The present invention pertains generally to the field of alarm and warning systems such as those utilized to initiate and/or facilitate evacuation, and more particularly to a warning system that may contain one or a plurality of sensors and provides programmable warning and/or evacuation alarms and verbal instructions in the event of an emergency.

BACKGROUND ART

Warning and alarm systems for alerting people to emergency and other abnormal conditions are well known in the art. Such devices range from simple fire alarms to more complex systems which employ a plurality of sensing devices. All of these devices involve either a central system actuated by local sensors to "sound" local alarms, or are self-contained local units, which are and must only be independent of any overall system interaction. For example, U.S. Pat. No. 3,798,672 shows a multiple condition sensing and audio warning system. The system includes a multi-track magnetic tape playing apparatus with a playback head selectively movable to any one of a plurality of track positions, an audio system connected to the output of the tape playing apparatus including speakers at selected locations, and a plurality of condition sensors each providing a signal representative of a condition being sensed. A control circuit is responsive to the condition signals and initiates operation of the tape playing apparatus. U.S. Pat. No. 4,107,464 illustrates an alarm communication system which includes a circuit for normally transmitting music to a plurality of different locations within a building which includes a source of music, a plurality of speakers selectively positioned throughout the building and a normally closed switch for connecting the source of music to each of the speakers. A source of programmed alarm announcements stored on tape is converted to an electrical signal, amplified and coupled to each of the speakers via an override switch. Actuation of the override switch in response to the occurrence of an emergency condition, such as fire, causes the normally closed switch to open and couple the electronic signal corresponding to the programmed alarm announcements to all of the speakers. U.S. Pat. No. 4,288,789 defines an alarm system having a verbal message for monitoring mining operations, or the like. The system includes a plurality of first sensors each providing a signal representation of an abnormal condition being sensed, at least one additional sensor providing a signal representing an emergency condition being sensed, an oscillator and modulator for generating an emergency warning tone energized upon detection of the emergency condition, a plurality of speakers at selected locations for broadcasting the emergency warning tone, a multi-track tape player with playback head selectively movable to any one of the track positions and having an audio output connected to local and remote speakers, and circuit means effective to energize the tape player and move its head to an appropriate track containing a prerecorded oral message upon detection of an abnormal condition by one of the first sensors. U.S. Pat. No. 4,415,771 discloses a public alert and advisory system for communication of emergency and/or other information from one or more central locations to a plurality of remote locations, such as by way of example, information regarding nuclear accident and evacuation procedures. The system utilizes conventional programming stations such as AM, FM or TV stations, central transmitting equipment, with emergency information being modulated by a second modulation technique different from the first modulation technique for ordinary programming so that conventional manually operated programming receivers will not be responsive to the emergency information. U.S. Pat. No. 4,531,114 portrays an intelligent fire safety system which includes exit sign units having couplings to smoke sensor and heat sensor for input information, a speech synthesizer and strobe light to provide output information, and a communication unit to provide communication coupling between exit sign units on a single floor and between interfloor interfaces and a central monitoring unit. The exit sign provides both a strobe light and a speech synthesizer which provides verbal instructions to floor occupants. U.S. Pat. No. 4,682,348 comprises a life safety audio system having a voice synthesizer and a constant volume telephone network. The system has a plurality of detectors for detecting alarm conditions located throughout the building, a plurality of speakers located throughout the building, a source of pre-stored voice messages which can be broadcast over the speaker, and a telephone network. U.S. Pat. No. 4,816,809 consists of a speaking fire alarm system which not only gives an alarm in voice on an occurrence of a fire, but also provides some information necessary for coping with the situation. The system includes a CPU, host computer, and voice synthesizer. U.S. Pat. No. 5,074,137 describes a programmable atmospheric stabilizer which uses one or more sensors for detecting a condition of potentially hazardous material within a container or some other enclosed atmosphere. The sensors connect to a first threshold detector which activates a first order correcting device when the sensor detects a first order hazard. The sensor also connects to a second threshold detector which activates a second correcting device when the sensor detects a second order hazard. U.S. Pat. No. 5,291,183 includes a multi-function alarming system which employs a vocoder which enables the alarm system to emit not only a buzzing sound but also a human voice. The alarm system has a microphone, a microphone amplifier, a vocoder, a memory, a preamplifier, a power amplifier and a speaker. U.S. Pat. No. 5,349,338 depicts a fire alarm system having recorded vocal warning messages and/or instructions. The system has a microphone by which a user can record a vocal message specifically suited for a small child or adult in need of verbal instructions. U.S. Pat. No. 5,663,714 shows a warning system for giving verbal instructions during a fire, comprising a smoke detector, a smoke detector output relay, a recording switch, a microphone, a digital recording and playback device, a timer/pulse generator, a pulse counter, a number of speakers, an amplifier and an alarm tone generator. U.S. Pat. No. 5,724,020 illustrates a voice warning system for fire accidents which includes a plurality of fire sensors, a first multiplex selector, a detecting and scanning circuit, a locking circuit, a decoding circuit, a memory circuit, a second multiplex selector, a scanning circuit, a load, a time pulse controlling circuit, a fire emergency assistance calling circuit, and a plurality of loudspeakers which give fleeing instructions to people in the building. U.S. Pat. No. 5,990,796 defines a flash and voice warning system generally comprising a power supply with charging circuit, a smoke sensor power supply and auto reset circuit, a smoke sensor (or manual operation), a circuit for converting current to voltage, a single-chip microprocessor, a 60 Hz square wave generator, a control circuit, a buffer, a current amplifier, a high-voltage circuit, N-discharge tube circuits, N-triggering circuits, a flash lamp direction control circuit, and a voice circuit.

DISCLOSURE OF INVENTION

The present invention is directed to a warning system which can detect any of one or more emergency conditions and provide any or any combination of multiple programmed responses thereto, each individually tailored to the specific type of emergency at hand and the specific location of the actual warning device within the system's area of operation. The warning systems includes a plurality of input trips which sense emergency conditions in a local area. The warning system then issues programmable emergency responses or alarms in the form of emergency lights, strobe lights, and audio messages (verbal, a siren, a buzzer, etc.). The warning system is capable of multiple responses (different sounds or messages, or combinations of sounds and messages, or messages in different languages or multiple languages) triggered by, or in response to, different emergency situations (fire, earthquake, explosion, intruders, presence of smoke, radiation, noxious or poisonous gases, and the like). The warning system is individually programmable to give differing specific instructions for evacuation from specific locations within the protected area. The warning system is capable of operation either individually or as part of a system for the protection of a larger area. If used as part of an overall system, the evacuation devices can be "connected" to the system either by direct wiring or by radio- or other remote control. If used as part of an overall system, all of the covered devices will be capable of sensing the failure or destruction, or disconnection by any means, of the central control device for the system of which they are a part, and upon so doing, will immediately and independently commence alarm and the issuance of preselected instructions.

In accordance: with a preferred embodiment of the invention, a warning system comprises a central control unit and a plurality of local units connected to the central control unit, each of the local units having a plurality of input trips and a plurality of programmable responses thereto; the plurality of input trips including a disconnect trip to indicate that the central control unit or connection thereto has failed.

In accordance with an important aspect of the invention, the plurality of programmable responses include a warning output signal sent from the local unit to the central control unit to indicate the presence of a local emergency.

In accordance with an important feature of the invention, the warning output signal is also sent when a loss of local unit power is detected.

In accordance with another important aspect of the invention, the plurality of input trips may include a smoke detector, an earthquake detector, a noxious/poison gas detector, a proximity/motion intruder detector, a radiation detector, an explosion detector, or any other sensing device. A TV camera, a digital still camera, a microphone and/or other video, photographic or audio monitoring device may also be included.

In accordance with another important feature of the invention, the plurality of programmable responses may include illumination of an emergency light, illumination of a strobe light, and the broadcast of an audio message (verbal, siren, buzzer, or the like).

In accordance with another important aspect of the invention, under emergency conditions, the central control unit may broadcast either or both of (1) preselected audio, and (2) live voice instructions, to one or more local units of which the local trips have not been tripped. Also, the local units may be equipped with a microphone so that verbal messages may be sent to the central control unit.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
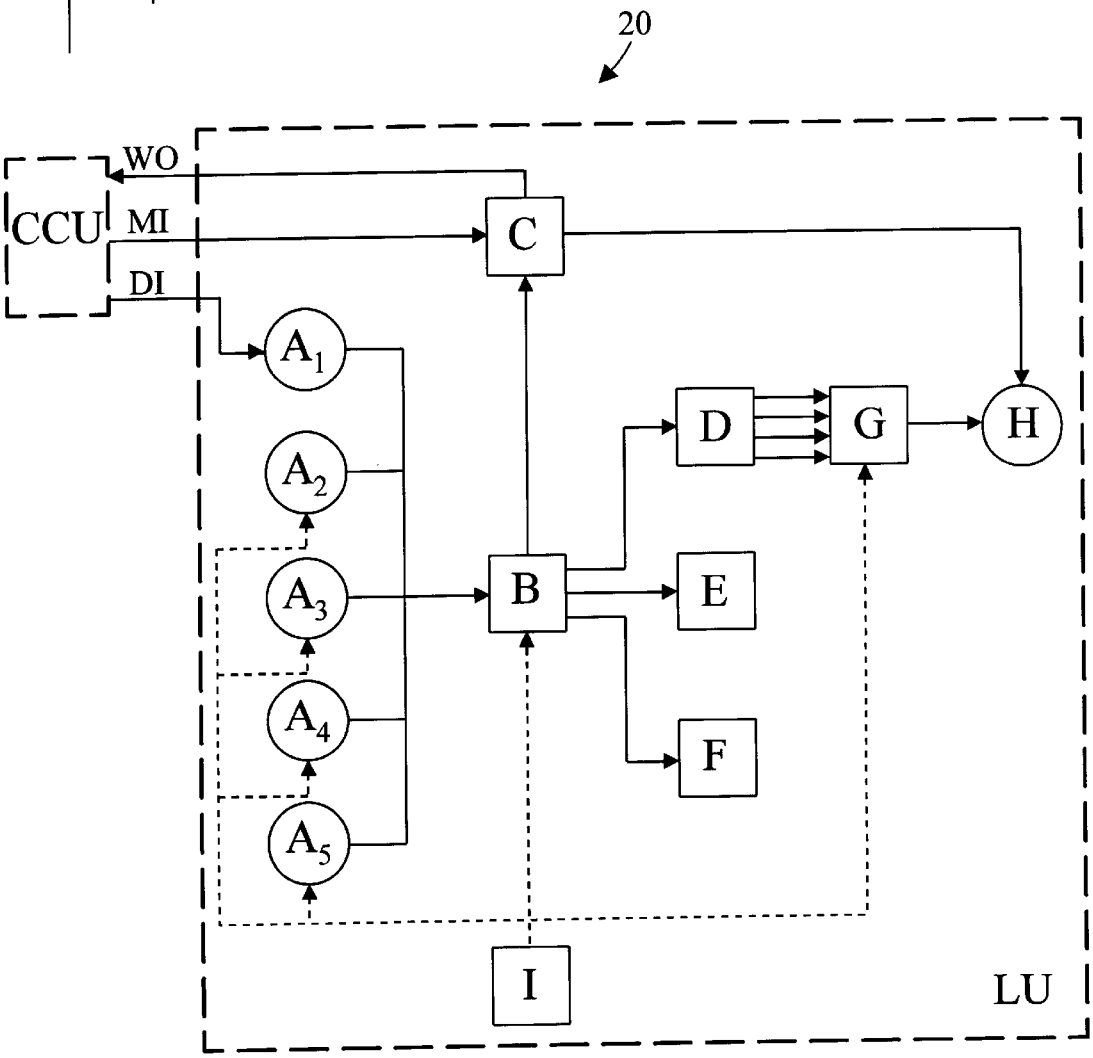
FIG. 1 is a block diagram of a warning system in accordance with the present invention; and, FIG. 2 is a matrix showing conditions and responses thereto.

Referring initially to FIG. 1, there is illustrated a block diagram of a warning system in accordance with the present invention, generally designated as 20. Warning system 20 includes the following components:

CCU. Central Control Unit

LU. Local Unit (one or more)

- $A_n$. Input Trips/Sensors;
- B. Control Electronics (including operating and switching functions);
- C. Bypass Relay;
- D. Record/Playback Unit;
- E. Emergency Light;
- F. Strobe Light;
- G. Amplifier;
- H. Loudspeaker; and,
- I. Battery.

Warning system 20 also includes the following signals:

MI. Music/Paging Input;

DI. Detector Input; and,

WO. Warning Output.

It may be appreciated that while only one local unit LU is shown in FIG. 1, a plurality of local units LU, each disposed in a different local area, may be connected to the central control unit CCU.

The central control unit CCU comprises the central monitoring and control station of warning system 20. A plurality of local units LU are connected to the central control unit CCU (either hardwired, by RF, or by other means). Each of the plurality of local units LU has a plurality of input trips $A_n$ and a plurality of programmable responses thereto. The plurality of programmable responses for each local unit LU are tailorable to meet the needs of a particular location. Input trips $A_n$ can include any number of sensor/transducer devices that detect an emergency or abnormal condition. For example, input trip $A_2$ could be a smoke detector, input trip $A_3$ could be an earthquake detector, input trip $A_4$ could be a proximity or motion detector, and input trip $A_5$ could be a noxious or poison gas detector. Input trips could also include devices to sense AC power failure, heat sensors, radiation sensors, explosion sensors, or any other devices which could report the presence of an emergency or abnormal occurrence at the local unit LU. Audio, video, photographic or other monitoring devices could be included, along with various input trips $A_n$. The plurality of input trips $A_n$ also includes a disconnect trip $A_1$ which indicates that the central control unit CCU or connection thereto has failed. Disconnect trip $A_1$ is activated by loss of the detector input DI signal which is sent to the local units LU from the central control unit CCU. Failure of this signal indicates failure, destruction, or disconnection, of the central control unit CCU. The signal sent to detector input DI may be DC, RF, IR, or any other convenient transmission format.

The plurality of programmable responses includes various alarms such as illumination of an emergency light E, illumination of a strobe light F (for the hearing impaired), and a plurality of audio messages (verbal voice messages broadcast in a plurality of different languages, siren, buzzer, etc.) as output from record/playback unit D. The exact number and content of the programmable responses is selectively controlled by the control electronics B. The plurality of programmable responses also includes a warning output WO signal which is sent from the local unit LU to the central control unit CCU to indicate the presence of a local emergency. In a preferred embodiment, the warning output WO signal is also sent when a loss of local unit LU power is detected.

Control electronics B contain all of the control, switching, programming, and operating circuitry necessary to initiate the desired emergency responses. Control electronics B cause the appropriate message from the record/playback unit D to be sent to amplifier G to power loudspeaker H. It may be appreciated that the present invention can be designed and programmed to provide any desired response to any number of emergency or abnormal conditions.

Record/playback unit D contains a plurality of prerecorded emergency messages and instructions that are selected by the control electronics B depending upon the nature of the emergency as detected by the input trips $A_n$. The record/playback unit can employ tape, IC-controlled, or any other recording and playback technology.

Under non-emergency conditions, the central control unit CCU broadcasts preselected audio MI (for example music and/or paging messages) to each of the local units LU. However, when one of input trips $A_n$ is activated, the control electronics B cause bypass relay C to disconnect the preselected audio MI, and substitute the appropriate programmable response from the local unit LU. That is, loudspeaker H is driven by control electronics B, record/playback unit D, and amplifier G, rather than from music/paging input (preselected audio) MI. Concurrently, the warning output WO signal notifies the central control unit CCU that bypass relay C has been activated, thereby indicating a local emergency.

Amplifier G, loudspeaker H, and battery I comprise conventional readily available electronics technology.

In another preferred embodiment, if an emergency condition outside the area of the local unit LU is detected (i.e. no local input trip has been activated), it still may be desirable to broadcast emergency messages or instructions. In this instance, all alarms or instructions will come to the local unit LU from the CCU by way of the music/paging input MI. Also, the local units LU may be equipped with a microphone so that verbal messages may be sent to the central control unit CCU.

In another possible embodiment, local unit LU could operate as a stand alone system without the central control unit CCU.

FIG. 2 is a matrix showing various emergency conditions and possible programmed responses thereto. For example, if smoke is detected at a local unit LU, the emergency lights are illuminated, strobe lights are illuminated, the normal audio MI (e.g. music/paging) from the CCU is disconnected, an audio message (verbal, siren, buzzer, etc.) is broadcast, and a warning output WO signal is sent from the local unit LU to the central control unit CCU indicating that an emergency condition exists. In a preferred embodiment, if an intruder is detected by a proximity/motion input trip $A_4$, no local response (e.g. emergency lights, strobe light, etc.) is directed, however the warning output WO signal is sent to the central control unit CCU in the form of a "silent alarm". If loss of local unit LU power is detected, the warning output WO signal is also sent to the central control unit CCU. If failure or destruction of the central control unit CCU is detected through loss of the detector input DI signal, in a preferred embodiment all of the local unit LU response devices are activated.

In terms of physical construction, the present invention can be fabricated in three or more physical configurations. These are:

"EXIT SIGN"—Either one or two-sided, and may be mounted either in or on a wall or suspended from the ceiling or other support structure.

"BOX"—This may be mounted to a wall, bracket-mounted, or suspended from a ceiling or other support structure.

"FLUSH"—This will be flush-mounted (or possibly concealed, either for cosmetic or security reasons) in a wall or ceiling.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of programmable responses including a warning output signal sent from said local unit to said central control unit which indicates the presence of a local emergency.

2. A warning system according to claim 1, further including:

said warning output signal being sent when a loss of local unit power is detected.

3. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of input trips including a smoke detector.

4. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of input trips including an earthquake detector.

5. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of input trips including a motion detector.

6. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of input trips including a noxious or poisonous gas detector.

7. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of programmable responses including illumination of an emergency light.

8. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, said plurality of programmable responses including illumination of a strobe light.

9. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, under non-emergency conditions, said central control unit broadcasting preselected audio to each of said local units.

10. A warning system according to claim 9, further including:

when one of said input trips is activated, said preselected audio is disconnected.

11. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed; and, under emergency conditions, said central control unit allows for broadcasting at least one of (1) preselected audio, and (2) live voice instructions to at least one of said local units, of which no local trip has been tripped.

12. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed;

said plurality of programmable responses including a warning output signal sent from said local unit to said central control unit which indicates the presence of a local emergency;

said warning output signal being sent when a loss of local unit power is detected;

said plurality of input trips including a smoke detector;

said plurality of input trips including an earthquake detector;

said plurality of input trips including a motion detector;

said plurality of input trips including a noxious or poisonous gas detector;

said plurality of programmable responses including illumination of an emergency light;

said plurality of programmable responses including illumination of a strobe light;

said plurality of programmable responses including the broadcast of an audio message;

under non-emergency conditions, said central control unit broadcasting preselected audio to each of said local units; and, when one of said input trips is activated, said preselected audio is disconnected.

13. A warning system, comprising:

a central control unit;

a plurality of local units connected to said central control unit;

each of said plurality of local units having a plurality of input trips and a plurality of programmable responses thereto;

said plurality of programmable responses for each said local unit tailorable to meet the needs of a particular location;

said plurality of input trips including a disconnect trip indicating that said central control unit has failed;

said plurality of programmable responses including the broadcast of an audio message; and, said audio message being a verbal message that is broadcast in a plurality of different languages.

* * * * *

US006518878C1

(12) EX PARTE REEXAMINATION CERTIFICATE (10096th)

United States Patent

Skoff

(10) Number: US 6,518,878 C1

(45) Certificate Issued: Apr. 3, 2014

(54) WARNING SYSTEM

(75) Inventor: Roger E. Skoff, Rancho Cucamonga, CA (US)

(73) Assignee: Watchguard Isle, LLC, Wilmington, DE (US)

Reexamination Request:
No. 90/011,706, May 23, 2011

Reexamination Certificate for:

| | |
|---|---|
| Patent No.: | **6,518,878** |
| Issued: | **Feb. 11, 2003** |
| Appl. No.: | **09/538,323** |
| Filed: | **Mar. 30, 2000** |

(51) Int. Cl.
*G08B 7/00* (2006.01)
*G08B 7/06* (2006.01)

(52) U.S. Cl.
USPC ..... 340/506; 340/511; 340/517; 340/521; 340/533

(58) Field of Classification Search
None
See application file for complete search history.

(56) References Cited

To view the complete listing of prior art documents cited during the proceeding for Reexamination Control Number 90/011,706, please refer to the USPTO's public Patent Application Information Retrieval (PAIR) system under the Display References tab.

*Primary Examiner* — Adam Basehoar

(57) ABSTRACT

A warning system (20) includes a central control unit (CCU), and a plurality of local units (LU) connected to the central control unit (CCU). Each local unit (LU) includes a plurality of input trips ($A_n$), such as smoke detector, an earthquake detector, and gas detector, and a plurality of programmable responses, such as a bypass relay (C), a message delivered by a record/playback unit (D), an emergency light (E), and a strobe light (F). The input trips ($A_n$) also include a disconnect trip ($A_1$), which is activated by a detector input signal (DI) sent from the central control unit (CCU), and indicates that the central control unit (CCU) has malfunctioned. The programmable responses include a warning output signal (WO) which is sent from the local unit (LU) to the central control unit (CCU) to indicate the presence of a local emergency at the local unit (LU).

At the time of issuance and publication of this certificate, the patent remains subject to pending reissue application number 14/201,291 filed Mar. 7, 2014. The claim content of the patent may be subsequently revised if a reissue patent is issued from the reissue application.

| CONDITION | RESPONSE: Emergency Light | Strobe Light | Normal Audio (MI) disconnected | Audio Message broadcast | Signal to CCU (WO) |
|---|---|---|---|---|---|
| SMOKE detected | YES | YES | YES | YES | YES |
| EARTHQUAKE detected | YES | YES | YES | YES | YES |
| PROXIMITY/ MOTION detected | NO | NO | NO | NO | YES |
| NOXIOUS/POISON GAS detected | YES | YES | YES | YES | YES |
| LOSS OF LOCAL POWER detected | NO | NO | NO | NO | YES |
| LOSS OF CCU detected (DI) | YES | YES | YES | YES | NO |

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-13 are cancelled.

* * * * *